US007984696B2

(12) United States Patent
Horrocks

(10) Patent No.: US 7,984,696 B2
(45) Date of Patent: Jul. 26, 2011

(54) ADJUSTABLE CROSS PIECE SOCKET ASSEMBLY AND METHODS OF USING THE SAME

(75) Inventor: Cynthia Lois Hinds Horrocks, Lake Placid, NY (US)

(73) Assignee: Field Jumps LLC, Lake Placid, NY (US)

( * ) Notice: Subject to any disclaimer, the term of this patent is extended or adjusted under 35 U.S.C. 154(b) by 136 days.

(21) Appl. No.: 12/570,898

(22) Filed: Sep. 30, 2009

(65) Prior Publication Data

US 2010/0077966 A1 Apr. 1, 2010

Related U.S. Application Data

(60) Provisional application No. 61/194,659, filed on Sep. 30, 2008, provisional application No. 61/204,273, filed on Jan. 6, 2009, provisional application No. 61/210,948, filed on Mar. 25, 2009.

(51) Int. Cl.
*A01K 15/02* (2006.01)

(52) U.S. Cl. ..... 119/705; 482/17

(58) Field of Classification Search ..... 119/702, 119/705; 482/15–17, 93–94, 142; 248/216.4, 248/219.2, 235, 250
See application file for complete search history.

(56) References Cited

U.S. PATENT DOCUMENTS

| | | | | |
|---|---|---|---|---|
| 2,989,309 | A | 6/1961 | Conrad et al. | |
| 5,586,520 | A * | 12/1996 | Cleary | 119/705 |
| 5,690,583 | A | 11/1997 | Keusch | |
| 5,913,283 | A | 6/1999 | Coury | |
| 6,520,119 | B1 | 2/2003 | Johnson | |
| 2006/0283399 | A1 | 12/2006 | Bolduc | |

OTHER PUBLICATIONS

"Catalog Page", Found before filing, (Sep. 8, 2009), 1 pg.
"Easiest Jump Cup Yet", Dover Saddlery, [Online]. Retrieved from the Internet: <URL: http://www.doversaddlery.com>, (Sep. 8, 2009), 2 pgs.
"Safer Building Materials", [Online]. Retrieved from the Internet: <URL: http://www.saferbuildingmaterials.com/>, (Sep. 10, 2009), 1 pg.
"Safer Building Materials debuts PROLOGS", [Online]. Retrieved from the Internet: <URL: http://www.horsedeals.com.au/gallery.php?showID=4938>, (Jul. 18, 2008), 2 pgs.
Daily, Emily, "Explaining the Frangible Pin Rule", [Online]. Retrieved from the Internet: <URL: http://useventing.com/blog/?p=1971>, (Mar. 2, 2009), 2 pgs.
Deans, Tim, et al., "Goodyear Safety Research Project", (2008), 20 pgs.

* cited by examiner

*Primary Examiner* — Rob Swiatek
*Assistant Examiner* — Ebony Evans
(74) *Attorney, Agent, or Firm* — Schwegman, Lundberg & Woessner, P.A.

(57) ABSTRACT

A cross piece socket assembly includes a first resting bracket spaced from a second resting bracket. The cross piece socket assembly further includes at least one hoop support. The hoop support includes a hoop anchor portion selectively engageable with one of the first and second resting brackets. First and second arms extend from the hoop anchor portion. A cradle socket is fixed between the first and second arms, and the cradle socket is configured to secure the cross piece bar within the cradle socket where the cross piece bar is struck with an impact force less than an impact force capable of causing a horse or rider to fall. When repositioning the cross piece bar at a different height the hoop anchor portion is disengaged from the first resting bracket and moved to the second restring bracket with the cross piece bar continuously secured in the cradle socket.

29 Claims, 13 Drawing Sheets

ADJUSTABLE CROSS PIECE SOCKET ASSEMBLY AND METHODS OF USING THE SAME

RELATED DOCUMENTS

This application claims the benefit under 35 U.S.C. 119 (e) of U.S. Provisional Application Ser. No. 61/194,659 filed Sep. 30, 2008, U.S. Provisional Application Ser. No. 61/204,273, filed Jan. 6, 2009, and U.S. Provisional Application Ser. No. 61/210,948, filed Mar. 25, 2009, all of which are hereby incorporated by reference in their entirety

BACKGROUND

Jump structures are erected for equestrian competitions, such as eventing, and include cross piece bars positioned at a fixed height between posts. In eventing the cross piece bars are fixed in place. For example, the cross piece bars are lashed or fastened to the posts to permanently secure the cross piece bars at a specified heights and positions. The heights of the cross piece bars are determined based on the rider skill level, the capabilities of the horse and the level of competition. The rider directs the horse to jump over one or more such cross piece bars and is scored according to several factors, such as the number of bars cleared, the height of the bars and the time taken to finish the course.

SUMMARY

The inventors are the first to discover a cross piece socket assembly capable of securing and releasing a cross piece bar according to impact forces that is also adjustable to different heights without removal of the cross piece bar. In one example, a method for adjusting the height of a cross piece bar includes mounting a hoop support to a substantially vertical post in a first location, the hoop support coupled to a first rest bracket positioned along the substantially vertical post, wherein the hoop support includes a cradle socket configured to receive a cross piece bar. The method further includes positioning the cross piece bar within the cradle socket. The hoop support is disengaged from the first rest bracket while the cross piece bar remains present in the cradle socket. The method further includes mounting the hoop support to the substantially vertical post at a second location having a second rest bracket while the cross piece bar remains present in the cradle socket, wherein the height of the cross piece bar corresponds to the location of the hoop support.

In another example, the cross piece socket assembly includes a first resting bracket and a second resting bracket spaced from the first resting bracket. The cross piece socket assembly further includes at least one hoop support. The hoop support includes a hoop anchor portion, the hoop anchor portion is selectively engageable with one of the first and second resting brackets. First and second arms extend from the hoop anchor portion. A cradle socket is fixed between the first and second arms, and the cradle socket is configured to secure the cross piece bar within the cradle socket where the cross piece bar is struck with an impact force less than an impact force capable of causing a horse or rider to fall. For instance, the cradle socket is sized and shaped to secure a cross piece bar in place against horizontal impact forces equal to or less than about 6 kN. In yet another example, the cradle socket is sized and shaped to secure a cross piece bar in place against vertical impact forces equal to or less than about 18 kN.

In still another example, the cradle socket is configured to release a cross piece bar secured in the cradle socket where the cross piece bar is struck with an impact force greater than or equal to the impact force capable of causing a horse or rider to fall.

The cross piece socket assembly and methods for using the assembly described herein secure a cross piece bar in place at a desired height over a range of impact forces delivered by a jumping horse. The cradle sockets of the hoop supports secure the cross piece bar in place when struck with impact forces that would fail to cause a horse or the rider to tumble or fall. The cradle sockets are configured to release the cross piece bar when struck with impact forces capable of causing a horse or rider to tumble or fall. Because the cradle sockets permit release of the cross piece bar a fall or tumble may be avoided because the obstacle of the bar is removed.

When repositioning of the cross piece bar at a different height is desired the hoop anchor portion of the cross piece socket assembly is disengaged from a first rest bracket with the cross piece bar still in the cradle socket. The hoop support is slid up or down the post to a desired rest bracket while the cross piece bar remains secured with the cradle socket. The hoop anchor portion is reengaged along the post and rests on the rest bracket. The cross piece bar is immediately ready for jumping at the new height. Time intensive removal and replacement of a cross piece bar to reposition a pin or jump cup is substantially avoided because the cross piece bar remains seated within the cradle socket of the hoop support throughout movement from the first rest bracket to the second rest bracket. Delays in competition are thereby minimized. Additionally, a single user can operate each of the hoop supports that carry the cross piece bar in sequence avoiding the need for additional assistance.

DETAILED DESCRIPTION

In the following detailed description, reference is made to the accompanying drawings which form a part hereof, and in which is shown by way of illustration specific embodiments in which the disclosure may be practiced. These embodiments are described in sufficient detail to enable those skilled in the art to practice the disclosure, and it is to be understood that other embodiments may be utilized and that structural changes may be made without departing from the scope of the present disclosure. Therefore, the following detailed description is not to be taken in a limiting sense, and the scope of the present disclosure is defined by the appended claims and their equivalents.

Figure 1A:
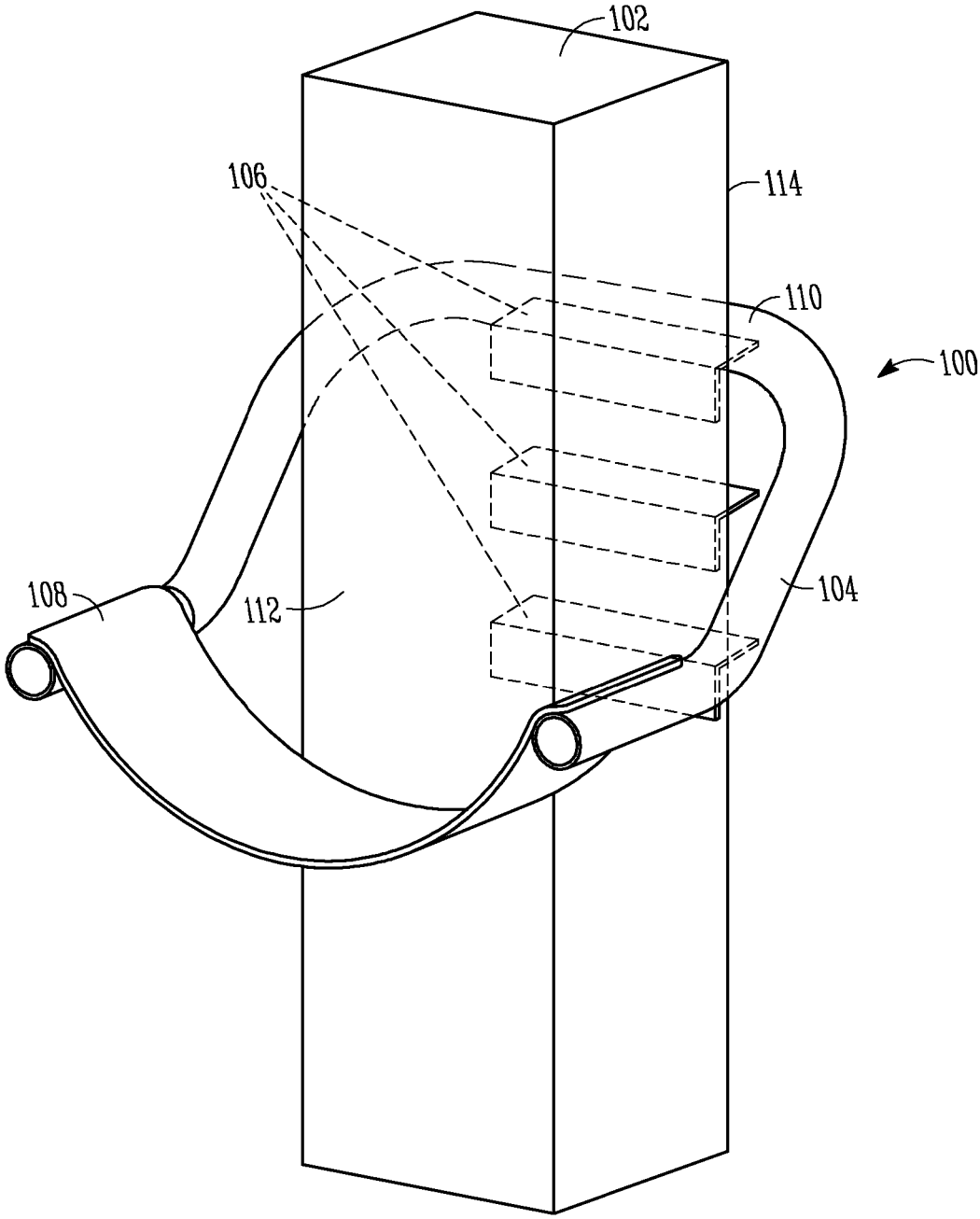
FIG. 1A is a first perspective view of one example of a cross piece socket assembly coupled around a post at a first engaged position in an embodiment of the disclosure.
Figure 1B:
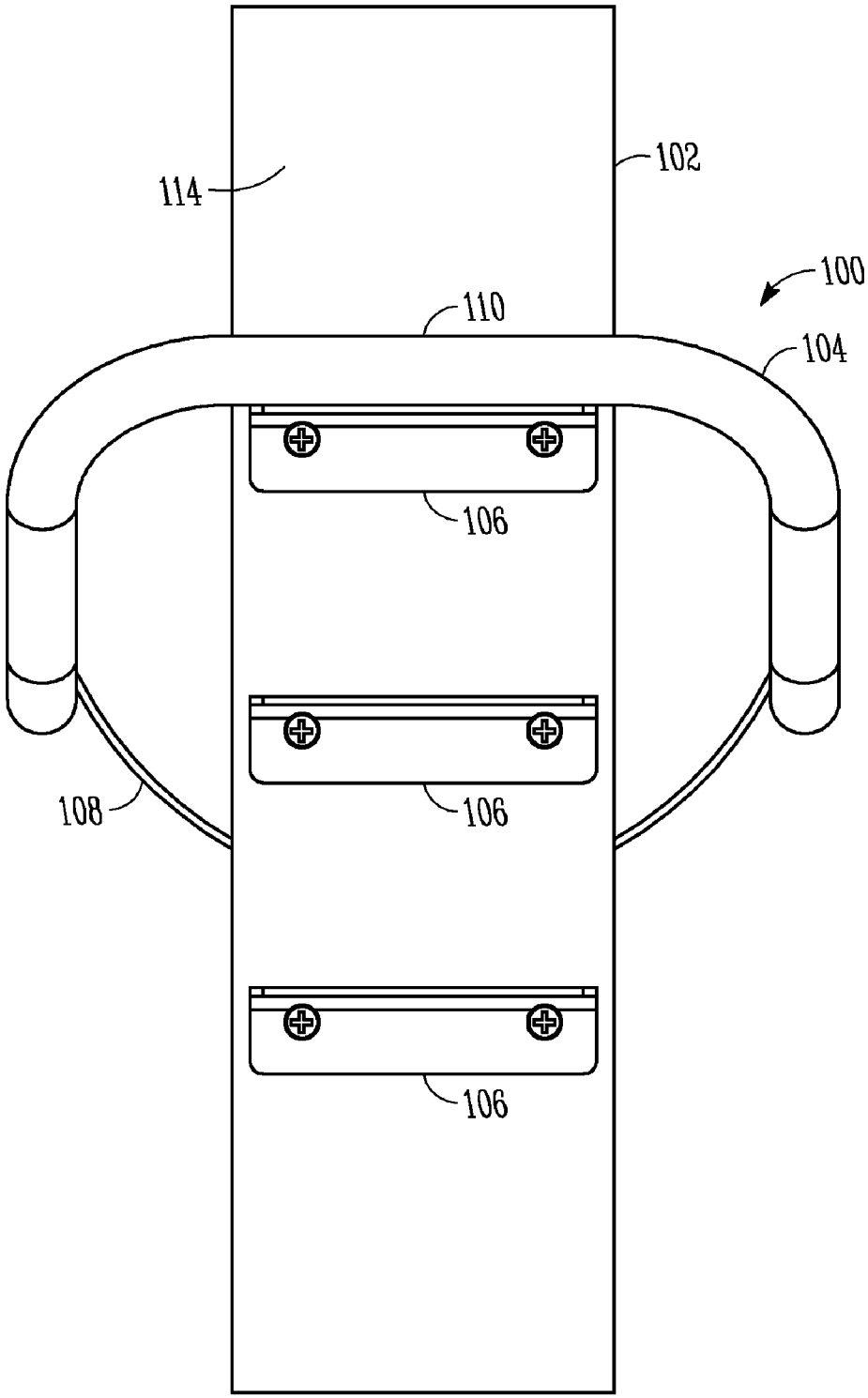
FIG. 1B is a second perspective view of the cross piece socket assembly shown in FIG. 1A with a hoop anchor portion seated on a rest bracket in an embodiment of the disclosure.

FIGS. 1A and 1B show one example of a cross piece socket assembly 100 configured to secure a cross piece bar (shown below) between posts 102 (one is shown in FIGS. 1A, B). The cross piece socket assembly 100 includes a hoop support 104 extending around one post 102 and adjustable to position a cross piece bar at two or more heights. To show the detail of the hoop support 104, a single hoop support is shown. The cross piece socket assembly 100 optionally includes two hoop supports 104, each configured for coupling around two separate posts. For instance, the hoop support 104 surrounds the post 102 and substantially prevents removal of the hoop support from the post 102 through the application of lateral forces, including the impact forces, against cross piece bars extending between the posts 102 and secured to the hoop supports 104.

The cross piece socket assembly 100 further includes rest brackets 106 positioned along the post 102 at specified locations. For instance, the rest brackets 106 are positioned along the post 102 at an interval facilitating positioning of the hoop support 104 on the rest bracket 106 at desired heights relative to the ground. Referring to FIG. 1B, a plurality of rest brackets 106 are coupled along the post 102 at various locations allowing for positioning of the hoop support 104 and the cross piece bar secured by the hoop support at one or more heights relative to the ground. A plurality of rest brackets 106 are coupled along a second post (not shown) for engagement and positioning of a second hoop support 104.

As shown in FIGS. 1A and 1B, the hoop support 104 further includes a cradle socket 108 sized and shaped to receive the cross piece bar therein. As will be described in further detail below, the cradle socket 108 is sized and shaped to retain a cross piece bar at a specified height when subjected to impact forces such as impact forces from a jumping horse. Further, the cradle sockets 108 are sized and shaped to facilitate the release of the cross piece bar secured therein when a horse impacts a cross piece bar with sufficient force to otherwise cause the horse to fall or tumble if the cross piece bar was fixed to the posts 102, e.g., where the cross piece bar is fastened to the post 102 with fasteners, lashing and the like. The shape of the cradle socket 108 is configured to secure a cross piece bar in place even when impacted by a horse making contact during a jump.

For instance, the cradle socket 108 retains the cross piece bar in place against impact forces that would fail to cause a horse to fall or tumble. The force at which the horse impacts the cross piece bar may vary considerably depending on the dimensions of the cross piece bar, the cross piece bar height, the speed of the horse, the size of the horse and the weight of the horse and rider. Additionally, the impact forces will vary based on what portion of the body of the horse makes contact with the cross piece bar. In one example, the cradle socket 108 secures the cross piece bar against impact forces less than about 20 kilonewtons (kN) (i.e., a force less than that needed to cause falling or tumbling of the horse).

In another example, the cradle socket 108 is configured to secure the cross piece bar in place against horizontal impact forces less than about 6 kN. In still another example, the cradle socket 108 is configured to secure the cross piece bar within the cradle socket against vertical impact forces less than about 18 kN. Where the horse impact forces against the cross piece bar exceeds these forces the cradle socket 108 is sized and shaped to permit the cross piece bar to leave the cradle socket and assist in preventing falling or tumbling of the horse and rider. This is a substantial improvement over previous systems that either fix the bar in place and increase the risk of falling or easily release the bar when struck with nearly any force and require constant replacement. The forces described herein are intended to be exemplary and not absolute values for securing and releasing a cross piece bar. As described in the examples herein and the prophetic example below the forces to maintain the cross piece bar in place and release the cross piece bar may vary. For instance, the forces to maintain and release the cross piece bar may vary depending on a number of factors including, but not limited to, the height of the jump, the weight of the horse and rider, the size of the horse, the speed of the horse at impact, the size and weight of the cross piece bar, and the like. Similarly, the shape of the cradle socket 108 may be changed to correspond with desired forces to secure and release the cross piece bar.

The hoop support 104 is engaged with the post 102 at a first post surface 112 and a second post surface 114. In the example shown in FIG. 1A, the cradle socket 108 is engaged against the first post surface 112. A hoop anchor portion 110 is engaged against the second post surface 114 as well as at least one of the rest brackets 106 (See FIG. 1B). Engagement of the hoop anchor portion 110 and cradle socket 108 with the opposed first and second post surfaces 112, 114 provides a ratcheting engagement of the hoop support 104 with the post 102. The weight of the hoop support 104 affirmatively engages the hoop anchor portion 110 and cradle socket 108 against the post 102. Additionally, the weight of the cross piece bar (e.g., a wooden log, beam and the like) within the cradle socket 108 transmits a large moment to the hoop support 104 to more tightly engage the hoop support 104 against the post 102.

Figure 2A:
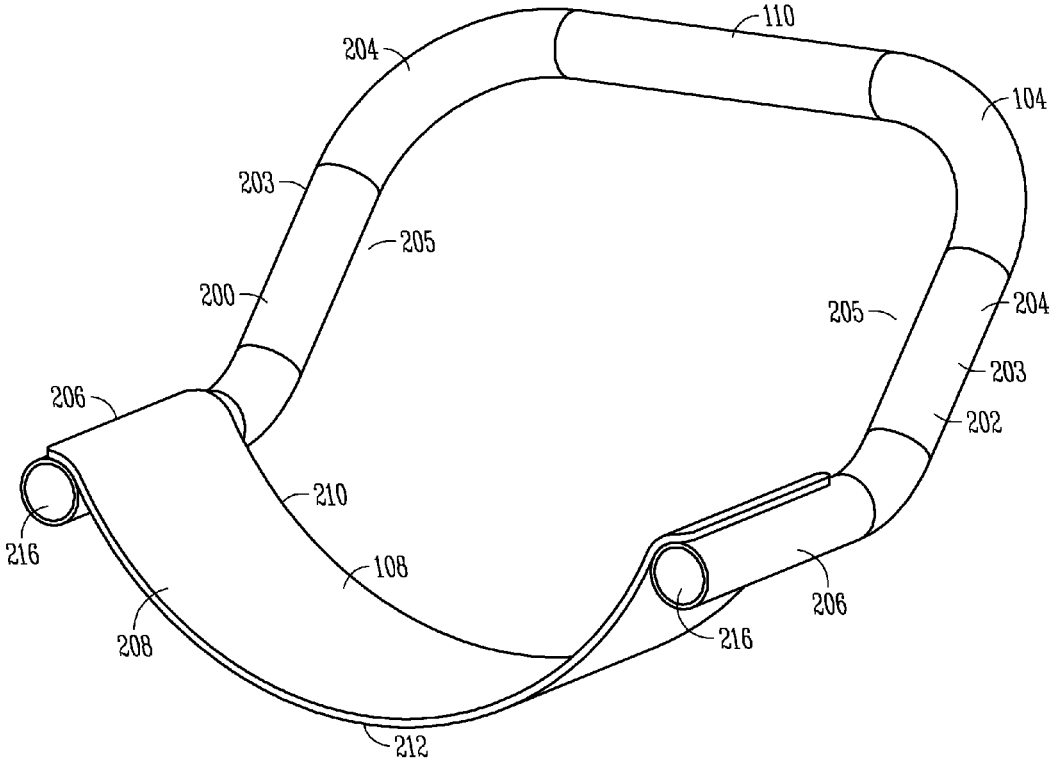
FIG. 2A is a perspective view of the hoop support of the cross piece socket assembly shown in FIG. 1.
Figure 2B:
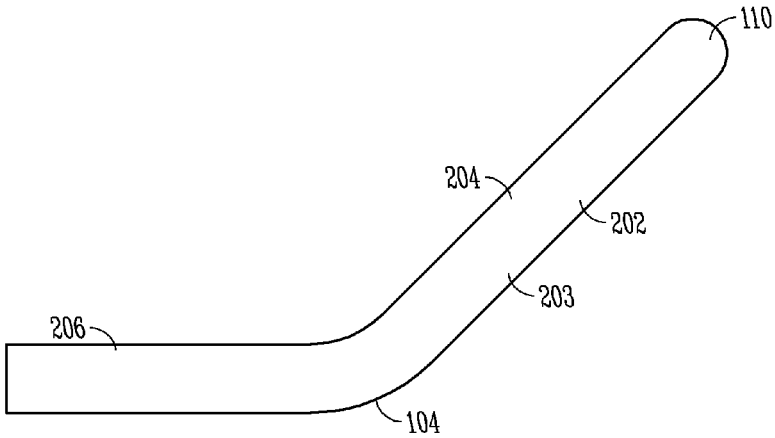
FIG. 2B is a side view of one example of the hoop anchor portion and arms of the hoop support shown in FIG. 2A.
Figure 2C:
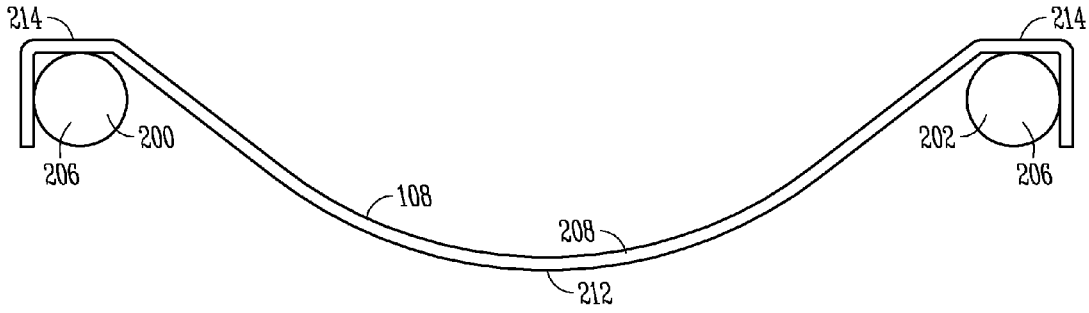
FIG. 2C is a front view of one example of the cradle socket of the hoop support shown in FIG. 2A.

As shown in FIGS. 2A, 2B and 2C, the hoop support 104 further comprises first and second arms 200, 202 extending between the hoop anchor portion 110 and the cradle socket 108 (FIG. 2A). The first and second arms 200, 202 together with the cradle socket 108 and hoop anchor portion 110 give the hoop support 104 a continuous hoop shape. In the example shown in FIG. 2A, the hoop support completely surrounds the post 102. A continuous hoop shape minimizes disengagement of the hoop support from the post 102, which may occur when impact forces are transmitted through a cross piece bar (shown below) to the hoop support.

In an alternative example, the hoop support 104 includes only the first arm 200 and the hoop support 104 extends partially around the post 102 (FIGS. 1A and 1B). Referring again to FIGS. 2A, B, the first and second arms 200, 202 include angled portions 204 and level portions 206. The level portions 206 are coupled with the cradle socket 108. The angled portions 204 and level portions 206 in the first and second arms 200, 202 orient the hoop support 104 on the post 102 and position the cradle socket 108 substantially perpendicular to the post 102. Positioning of a cradle socket surface 208 perpendicular to the post 102 provides a planar support surface for the cross piece bar when the bar is received within the cradle socket 108. Additionally, the angled portions 204 and level portions 206 ensure the hoop support 104 couples with the post 102 with a ratcheting engagement prior to positioning of the cross piece bar within the cradle socket 108. The ratcheting engagement of the hoop support 104 along the post 102 ensures the cradle socket surface 208 does not slip along the post 102 as the cross piece bar is positioned within the cradle socket 108 even when the hoop support 104 is not affirmatively engaged with the rest bracket 106. Unanticipated slipping of the hoop support 104 and the cross piece bar within the cradle socket 108 is thereby minimized.

Referring now to FIG. 2A, the cradle socket 108 is shown including the cradle socket surface 208. The cradle socket surface 208 extends from a cradle proximal edge 210 to the cradle distal edge 212. As shown in the example in FIG. 2A, the cradle socket surface 208 (i.e., a trough of the cradle socket 108) extends along the level portions 206 of the first and second arms 200, 202. Optionally, the cradle socket surface 208 extends along the level portions and at least a portion of the angled portions 204 of the first and second arms. The cradle proximal edge 210 of the cradle socket surface 208 engages against the first post surface 112 shown in FIG. 1 when the hoop support 104 is positioned on the post 102. The weight of the hoop support 104 firmly engages the cradle proximal edge 210 with the first post surface 112 and correspondingly engages the hoop anchor portion 110 with the second post surface 114 (e.g., ratcheting engagement). Similarly, positioning of the cross piece bar within the cradle socket 108 provides an additional moment to the hoop support 104 and more affirmatively engages the hoop anchor portion and cradle proximal edge 210 with the post 102 (the post 102 as shown in FIGS. 1A, 1B).

Referring now to FIG. 2C, the cradle socket 108 is shown extending between the first and second arms 200, 202. As previously described, in one example, the cradle socket 108 is coupled with the first and second arms along the level portions 206. As shown in FIG. 2C, the cradle socket 108 includes cradle flanges 214 sized and shaped to extend around at least a portion of the level portions 206 of the first and second arms 200, 202. Optionally, the cradle flanges 214 are coupled with the first and second arms 200, 202 with at least one of welds, adhesives, mechanical fasteners, screws, clamps, and the like. In another option, where the hoop support 104 including the first and second arms 200, 202 and the hoop anchor portion 110 are constructed with a tube, plugs 216 are provided for insertion into opposed ends of the first and second arms 200, 202. The plugs 216 substantially prevent the passage of water into the tubes of the arms 200, 202 and further prevent the ingress of particulate matter, insects and the like.

Figure 3:
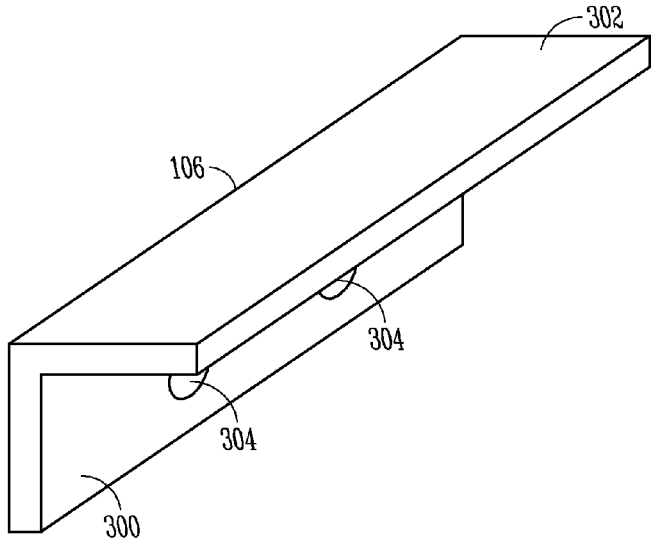
FIG. 3 is a perspective view of one example of a rest bracket configured to engage with the hoop anchor portion and position a cross piece bar at a specified location relative to the ground in an embodiment of the disclosure.

One example of a rest bracket 106 is shown in FIG. 3. The rest bracket 106 includes a coupling flange 300 and an engagement flange 302. The coupling flange 300, in one example, is sized and shaped for coupling with the post 102 (see FIGS. 1A, B) along the second post surface 114. As shown in FIG. 3, the coupling flange 300 includes, in one example, fastener lumens 304. The fastener lumens 304 receive fasteners including screws, nails and the like to fix the rest brackets 106 along the post 102. Optionally, the coupling flange 300 includes a barbed nailing surface and the rest bracket 106 is hammered into the post 102 to fix the rest bracket 106 in place.

The engagement flange 302 of the rest bracket 106 extends away from the coupling flange 300 and provides the resting surface for engagement with the hoop anchor portion 110 of the hoop support 104 (see FIGS. 1A, 1B). In one example, the engagement flange 302 extends across the second post surface 114 of the post 102. In another example, the engagement flange 302 extends across only a portion of the second post surface 114. Optionally, the rest brackets 106, like the hoop support 104, are constructed with metals including steel. When constructed with steel the rest brackets 104 and hoop support 104 are sealed, for instance with a powder coating, to substantially prevent corrosion of the hoop support and rest brackets. In another option, the rest brackets 106 and hoop supports 104 are constructed with resins including composite materials, such as plastics, having sufficient strength to support the hoop support and the cross piece bar received within the cradle socket 108 against impact forces from a jumping horse.

Figure 4:
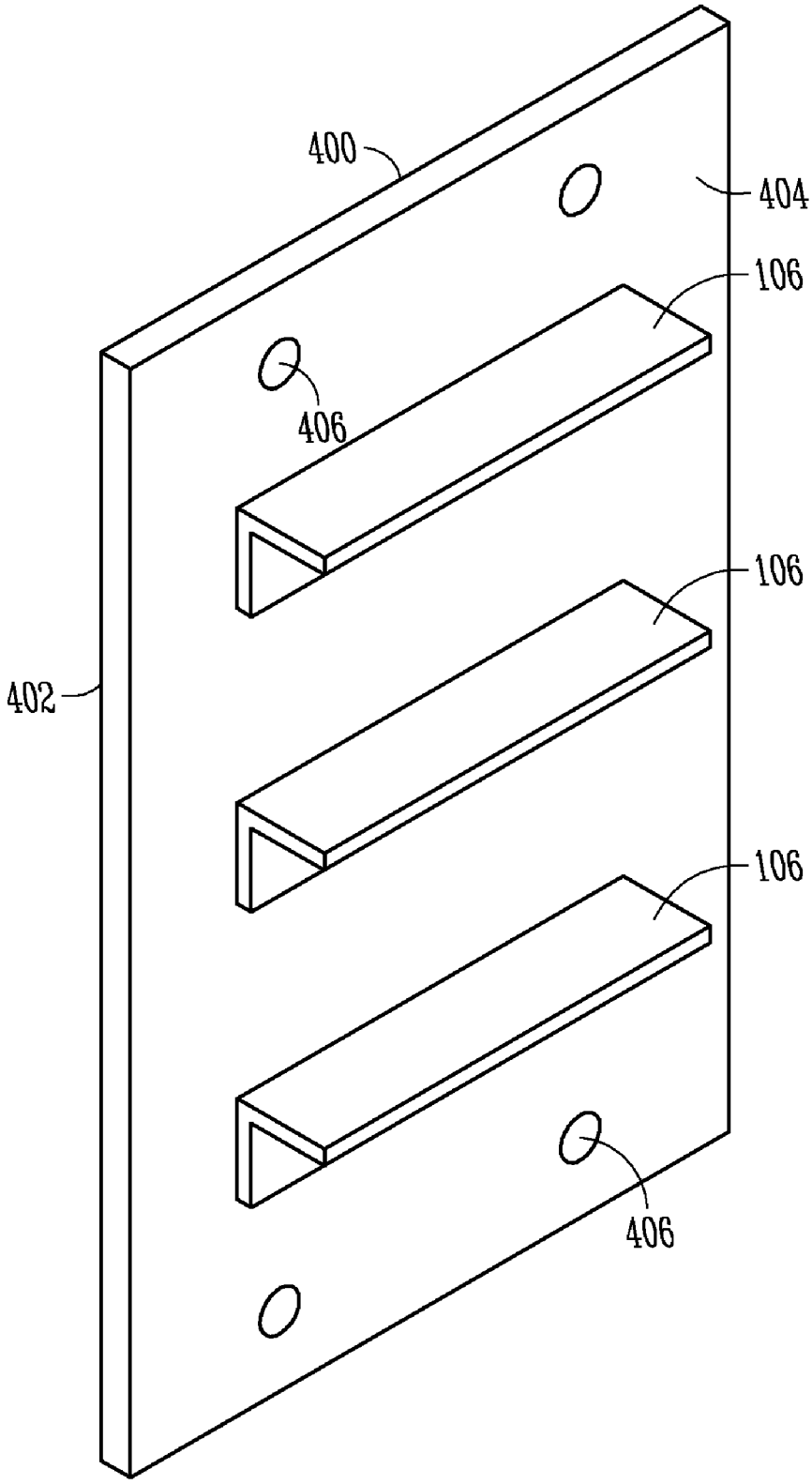
FIG. 4 is a perspective view of one example of a bracket plate configured to retain two or more rest brackets at specified positions on the bracket plate in an embodiment of the disclosure.

One example of a bracket plate 400 is shown in FIG. 4. The bracket plate 400 includes a bracket surface 404 sized and shaped to couple with a plurality of rest brackets 106. Optionally, the plurality of rest brackets 106 include the bracket plate 400. As shown in FIG. 4, in one example, the rest brackets 106 are positioned along the bracket plate 400 at specified locations, for instance, at a set interval. Positioning of the rest brackets 106 at specified locations along the bracket surface 404 eliminates the need for measuring the location of one rest bracket 106 relative to another rest bracket during installation of the cross piece socket assembly 100 along a post 102 (see FIGS. 1A, 1B). The rest brackets 106, in another example, are formed integrally with the bracket plate 400 (e.g., the rest brackets are welded, molded, formed and the like with the bracket plate 400). In still another example, the installer is able to mount the rest brackets 106 along the bracket plate 400 prior to installation of the bracket plate 400 along the post 102. For instance, the rest brackets 106 are fastened to the bracket plate 400 through the fastener lumens 304 shown in FIG. 3. The installer is thereby able to position and fix the rest brackets 106 along the bracket plate 400 at desired locations or at an interval.

The bracket plate 400 further includes a coupling surface 402 sized and shaped to engage along the post 102. The bracket plate 400 is coupled with the post 102, optionally, through fastener lumens 406 extending through the bracket plate 400. Mechanical fasteners including screws, nails and the like are driven through the fastener lumens 106 to position the bracket plate 400 and the rest brackets 106 along the post 102.

Figure 5:
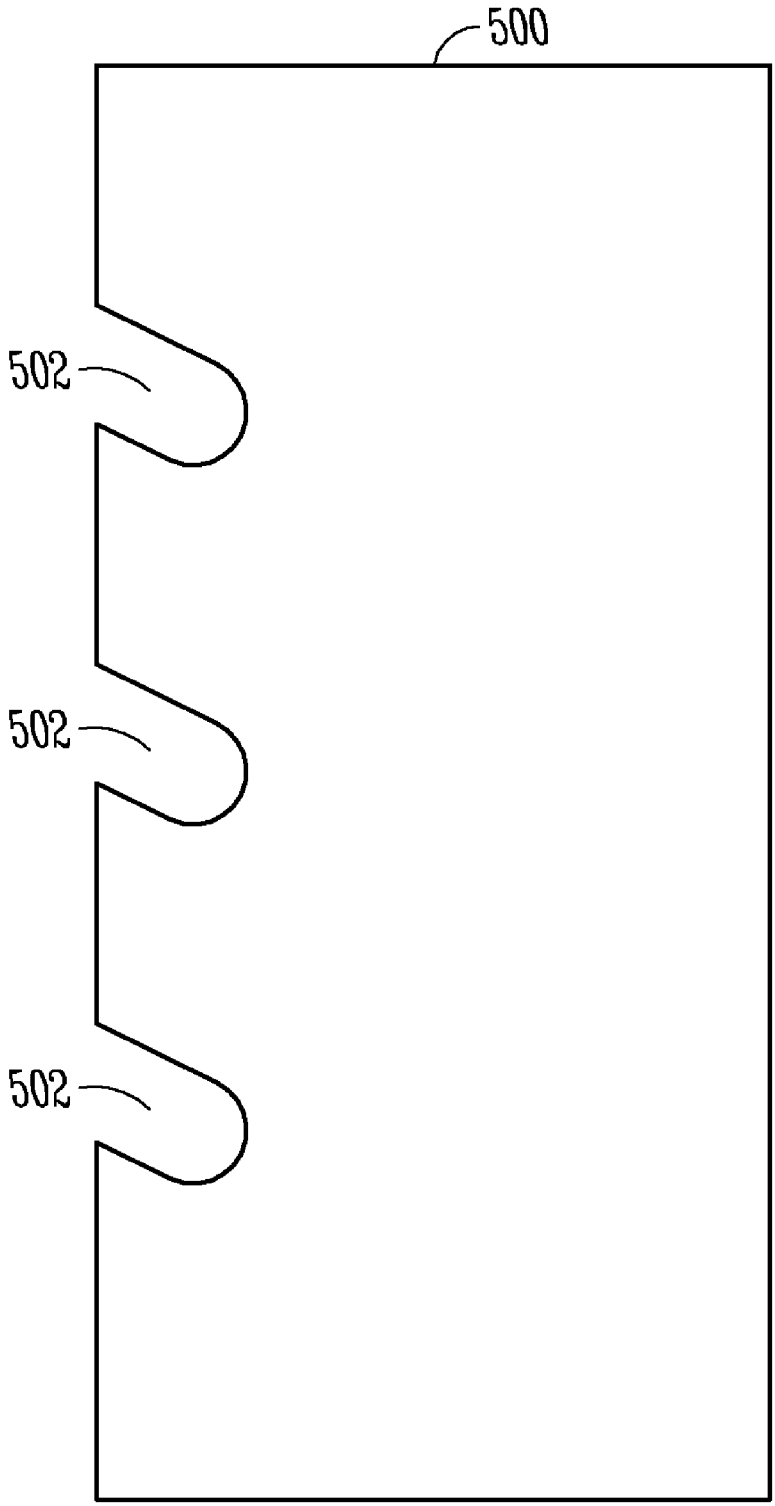
FIG. 5 is a side view of one example of a filleted post including two or more rest brackets in an embodiment of the disclosure.

Referring now to FIG. 5, another example of a post 500 is shown including rest brackets 502 formed within the post 500. The rest brackets 502 shown in FIG. 5, in one example, are filleted recesses cut into the material of the post. For example, the rest brackets 502 are cut into the post 500 by routing, molding, machining, and the like. The rest brackets 502, in a similar manner, to the rest brackets 106 described above, provide surfaces for engagement with the hoop anchor portion 110 of the hoop support 104 shown in FIGS. 1A, 1B.

In one example, the rest brackets 502 are formed within the post 500 at specified locations along the post 500 to correspondingly position the hoop support 104 at a variety of heights according to the desires of the users and ability levels of horses.

Figure 6:
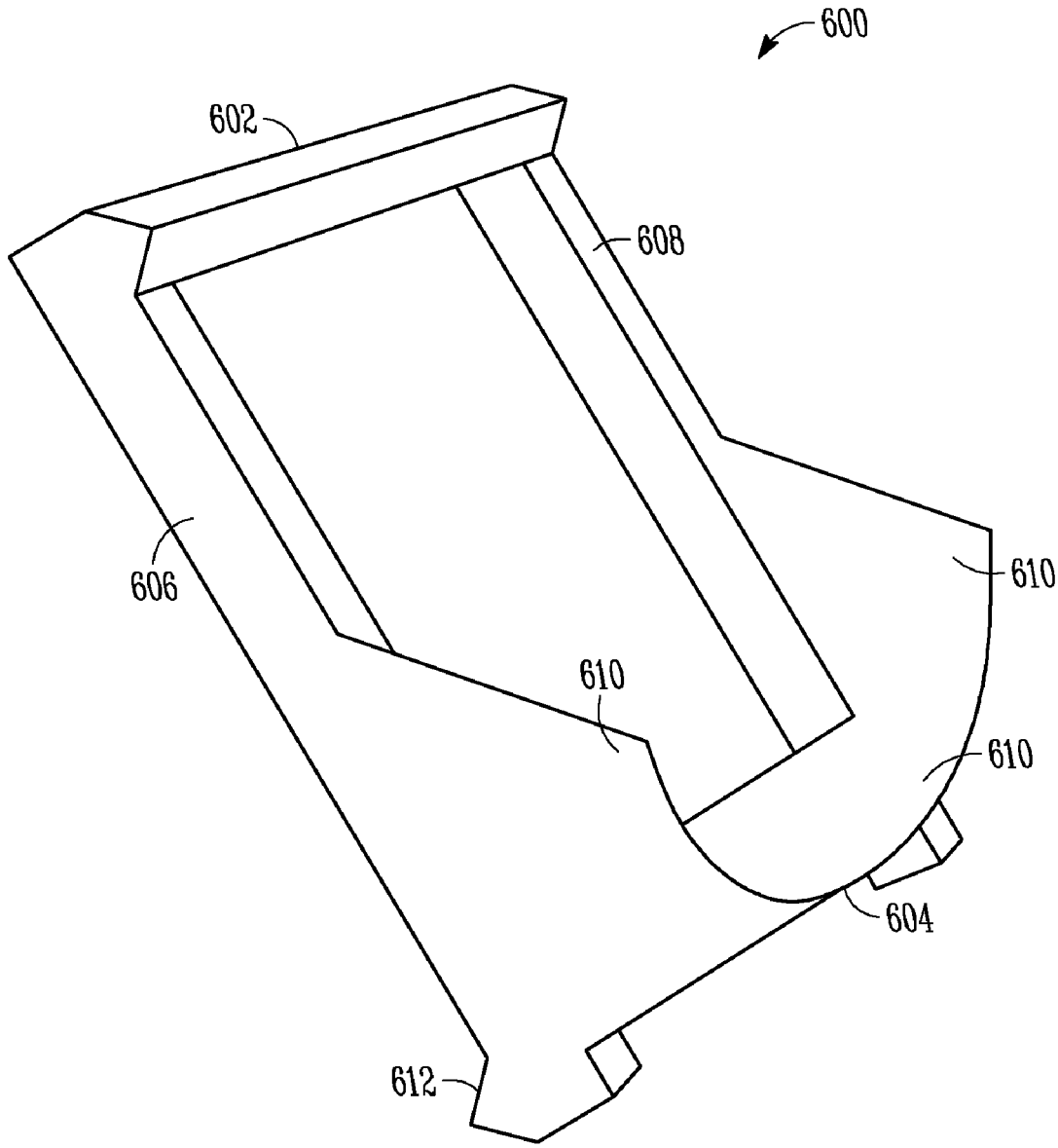
FIG. 6 is a perspective view of another example of a hoop support in an embodiment of the disclosure.

FIG. 6 shows another example of a hoop support 600 including a cradle socket 604 sized and shaped to receive and secure a cross piece bar. The hoop support 600 includes a hoop anchor portion 602 and cradle supports 612 that engage with the post 102 having rest brackets 106 (see FIGS. 1A, B) to securely position the hoop support 600 along the post. As shown in this example, the cradle support 612 is a separate feature of the hoop support 600 from the cradle socket 604. The cradle support 612 and the hoop anchor portion 602 provide opposed surfaces to engage with portions of the post 102. The hoop support 600 further includes first and second arms 606, 608 extending from the hoop anchor portion 602 to the cradle socket 604. In a similar manner to the hoop support 104, the first and second arms 606, 608, the hoop anchor portion 602 and the cradle socket 604 define a closed loop for the hoop support 600. The hoop support 600 fits around the post 102 and is substantially prevented from moving laterally (e.g., from an impact from a horse) and disengaging from the post.

The cradle flange 610 extending from the first and second arms 606, 608 and the cradle support 612 define the cradle socket 604. In one example, the cradle flanges 610 are formed in a shape corresponding to the shape of a cross piece bar received within the cradle socket 604. The cradle flanges 610 are configured to secure a cross piece bar in place even when impacted by a horse making contact with the fence. For instance, the cradle flanges 610 retain the cross piece bar in place against impact forces that would fail to cause a horse to fall or tumble.

The force at which a horse impacts the cross piece bar may vary considerably depending on the dimensions of the cross piece bar, the cross piece bar height, the speed of the horse, the size of the horse and the weight of the horse and rider. Additionally, the impact forces will vary based on what portion of the body of the horse makes contact with the cross piece bar. In one example, the cradle 604 of the hoop support 600 secures the cross piece bar against impact forces less than or equal to about 20 kN (less than an impact force needed to cause a jumping horse to fall or tumble). In another example, the cradle socket 604 is configured to secure the cross piece bar in place against horizontal impact forces less than or equal to about 6 kN. In still another example, the cradle socket 604 is configured to secure the cross piece bar within the cradle socket against vertical impact forces less than or equal to about 18 kN. Where the horse impact forces against the cross piece bar exceed these forces the cradle socket 604 is sized and shaped to permit the cross piece bar to leave the cradle socket and assist in preventing falling or tumbling of the horse and rider.

Figure 7:
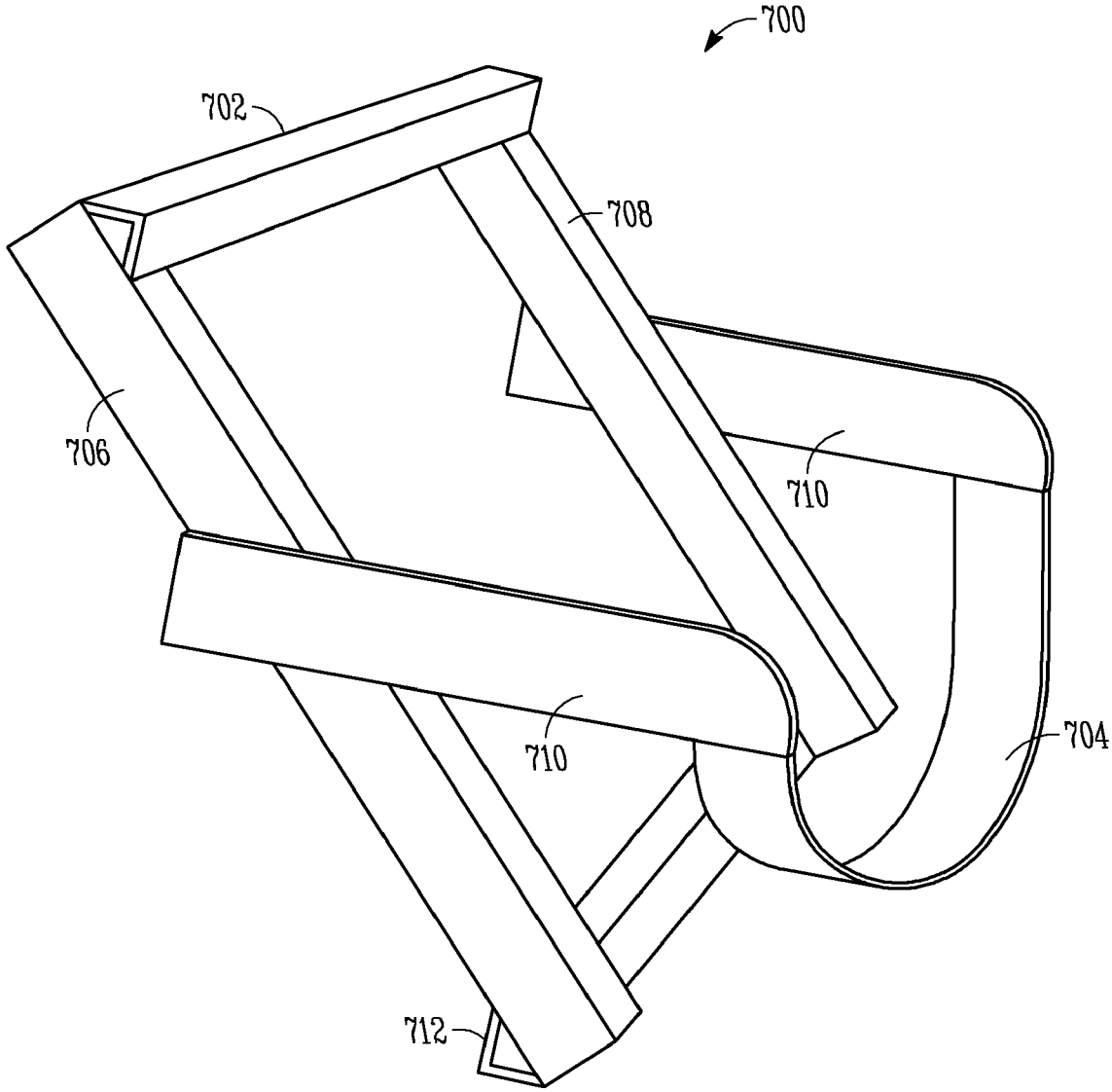
FIG. 7 is a perspective view of yet another example of a hoop support in an embodiment of the disclosure.

FIG. 7 shows yet another example of a hoop support 700 including a cradle socket 704 sized and shaped to receive and secure a cross piece bar extending between two posts, such as the post 102 shown in FIGS. 1A, B. In a similar manner to the previously described hoop supports 104, 600, the hoop support 700 includes a hoop anchor portion 702 and first and second arms 706, 708 extending toward the cradle socket 704.

In the example shown in FIG. 7, the cradle socket 704 is positioned away from the first and second arms 706, 708 with cradle arms 710 coupled with the first and second arms. When the hoop support 700 is positioned along a post, the cradle arms 710 position the cradle socket 704 away from the post. Optionally, the cradle arms 710 position the inner surface of the cradle socket 704 (the surface receiving the cross piece bar) at a level orientation to cradle the cross piece bar along the inner surface. A hoop bar 712 opposes the hoop anchor portion 702. The hoop bar 712 and hoop anchor portion 702 cooperate to fix the hoop support 700 along the post through ratcheting engagement against the opposing post surfaces 112, 114 (see FIGS. 1A, B).

The hoop supports 104, 600, 700, in one example, are constructed with high strength materials including metals, plastics, composites and the like. For instance, the hoop supports are constructed with, but not limited to, carbon steel with sufficient structural integrity to support a cross piece bar within the respective cradle sockets while the hoop supports are positioned along the post. Additionally, the hoop supports 104, 600, 700 are constructed with material, such as carbon steel, having sufficient structural integrity to withstand horse impact forces at least equal to or less than 20 kN. When subjected to such impact forces the hoop supports maintain their original shape and structural integrity and are capable of withstanding repeated impacts generating similar impact forces. The hoop supports are reusable and do not require replacement or repair as in other systems (e.g., frangible pins and frangible logs) that are designed to fail with impacts.

Figure 8:
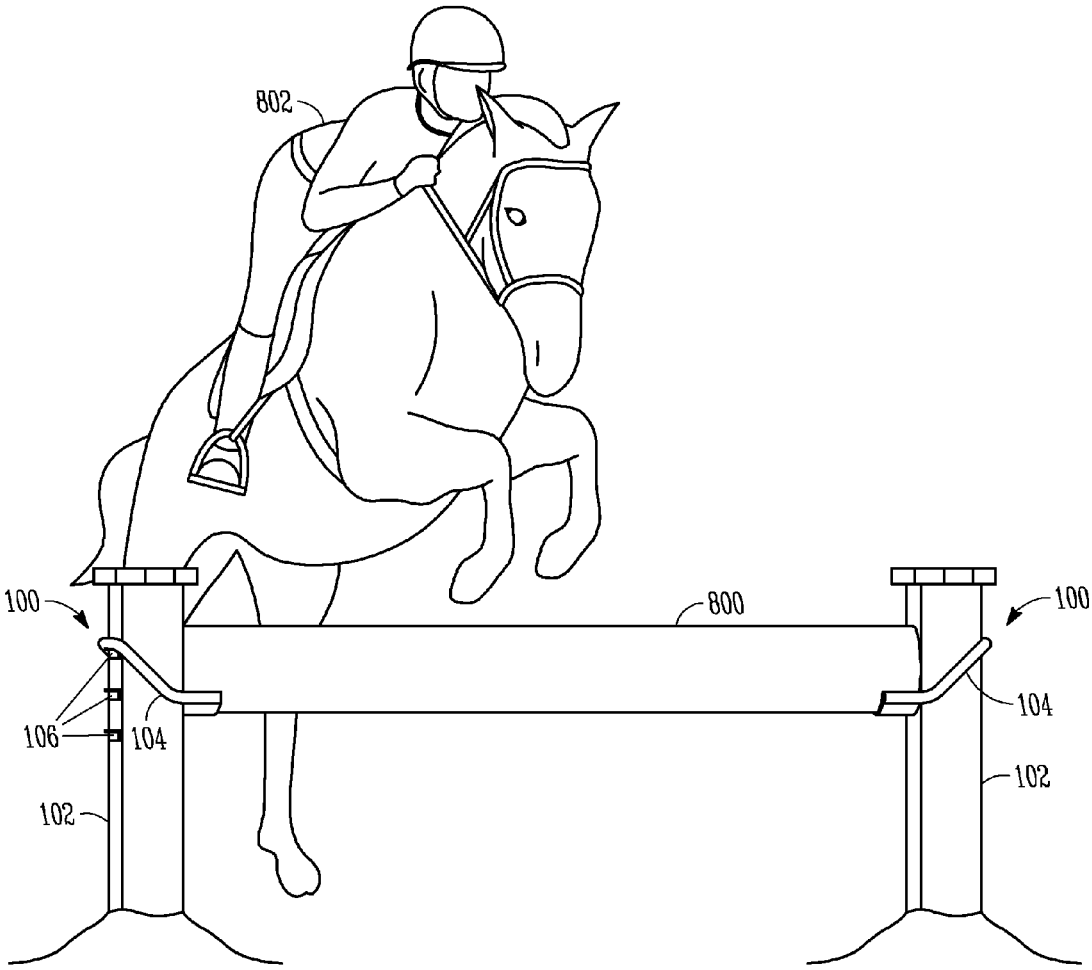
FIG. 8 is a perspective view of hoop supports as shown in FIG. 2A coupled along posts and securing a cross piece bar at a first engaged position in an embodiment of the disclosure.

FIG. 8 shows one example of a cross piece bar 800 coupled between posts 102. The cross piece bar 800 is supported between the posts 102 by hoop supports 104 of the cross piece socket assembly 100. As shown, the hoop supports 104 are positioned on the posts 102 and rest on the rest brackets 106. The rest brackets 106 position the hoop supports at a desired height and correspondingly position the cross piece bar 800 at a desired height for the horse and rider 802 to jump.

As previously described, the cradle sockets (e.g., cradles sockets 108, 604 and 704) are sized and shaped to secure the cross piece bar 800 within the hoop supports at the specified height along the posts 102. The cradle sockets 108, 604 and 704 provide deep recesses that secure the cross piece bar 800 in place against impact forces from a jumping horse and rider 802. To prevent falling and tumbling of the horse and rider 802, the cradle sockets are sized and shaped to release the cross piece bar 800 from the hoop supports when the cross piece bar 800 is impacted with sufficient force to otherwise cause a horse to fall or tumble (e.g., where a cross piece bar would be fixed to the posts). Stated another way, the hoop supports 104, 600 and 700 including the respective cradle sockets are configured to retain the cross piece bar 800 in position along the posts 102 when subjected to impact forces less than those that would cause the horse and rider 802 to tumble or fall. In contrast, other jump cup devices merely provide a groove or superficial cup and fail to retain the cross piece bar 800 in place against forces less than those that would otherwise cause tumbling or falling of the horse. Incidental impacts cause the cross piece bar 800 to fall from these devices, causing delays in competition and requiring additional labor to reposition the bar. Alternatively, where the bar is fixed in place and not releasable through impact, a strong impact against a fixed bar will increase the risk of falling or tumbling for both the horse and rider.

As described above, the impact forces from the horse and rider 802 can vary considerably according to the dimensions of the cross piece bar 800, the cross piece bar height, the horse's size, weight and speed at impact as well as what body part of the horse makes contact with the cross piece bar (e.g., chest, hoof, leg and the like). The novel cross piece socket assembly 100 (including the hoop supports 104, 600 and 700) secures the cross piece bar 800 in place at a desired position on the posts 102 when subjected to these varying impact forces from a horse that fails to fully clear the cross piece bar during a jump but can otherwise continue with the ride. The cross piece socket assembly 100 releases the cross piece bar 800 when subjected to impact forces that would cause the horse and rider 802 to fall or tumble (e.g., impact forces that are greater than those that would allow the horse to continue the ride without falling).

In one example, the cross piece socket assembly 100 including the hoop supports 104, 600 and 700 retains the cross piece bar 800 in place against impact forces of about 20 kN or less. In another example, the cross piece socket assembly 100 retains the cross piece bar in place against horizontal impact forces of about 6 kN or less. In still another example, the cross piece socket assembly 100 retains the cross piece bar 800 in place against vertical impact forces of about 18 kN or less.

The forces described herein are intended to be exemplary and not absolute values for securing and releasing a cross piece bar. As described in the examples herein and the prophetic example below the forces to maintain the cross piece bar in place and release the cross piece bar may vary. For instance, the forces to maintain and release the cross piece bar may vary depending on a number of factors including, but not limited to, the height of the jump, the weight of the horse and rider, the size of the horse, the speed of the horse at impact, the size and weight of the cross piece bar, and the like. Similarly, the shape of the cradle socket 108 may be changed to correspond with desired forces to secure and release the cross piece bar.

Figure 9A:
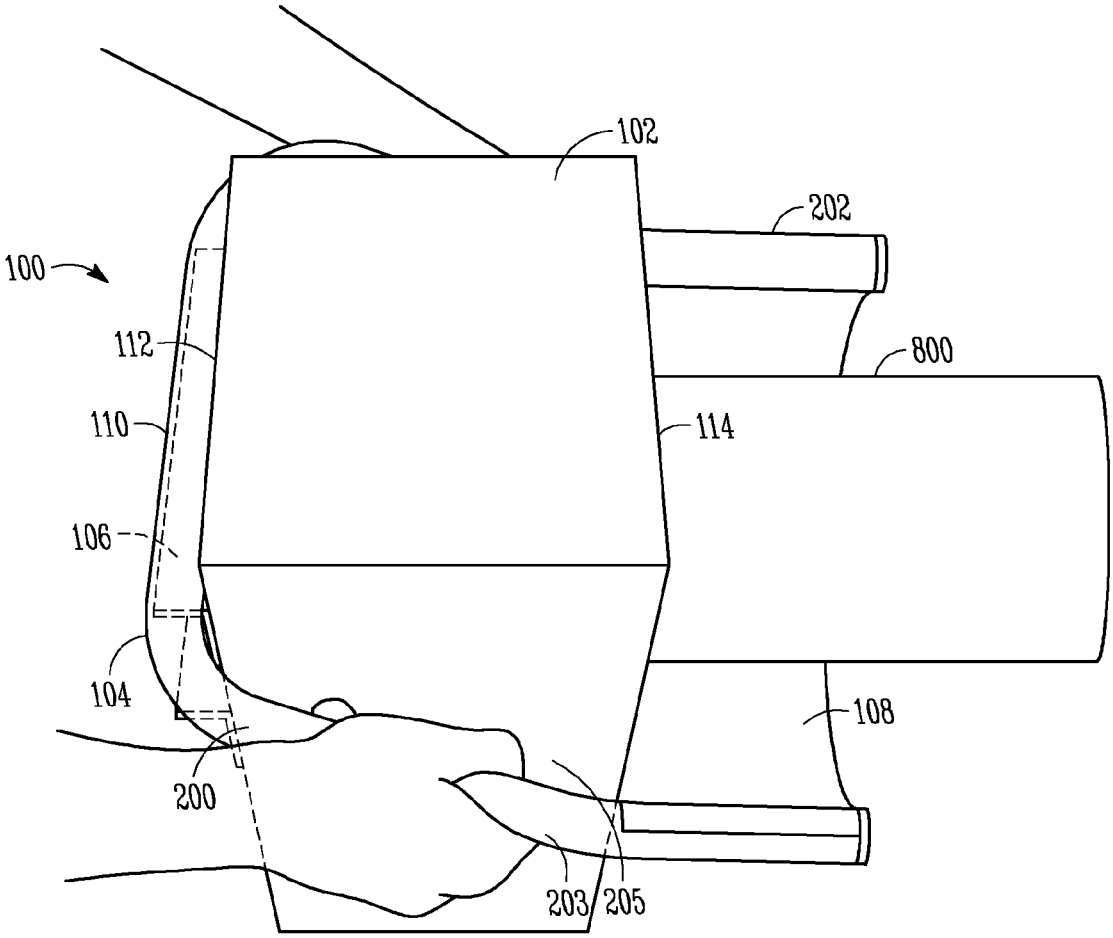
FIG. 9A is a detailed perspective view of the hoop support shown in FIG. 2A coupled along a post at a first engaged position while securing the cross piece bar in an embodiment of the disclosure.
Figure 9B:
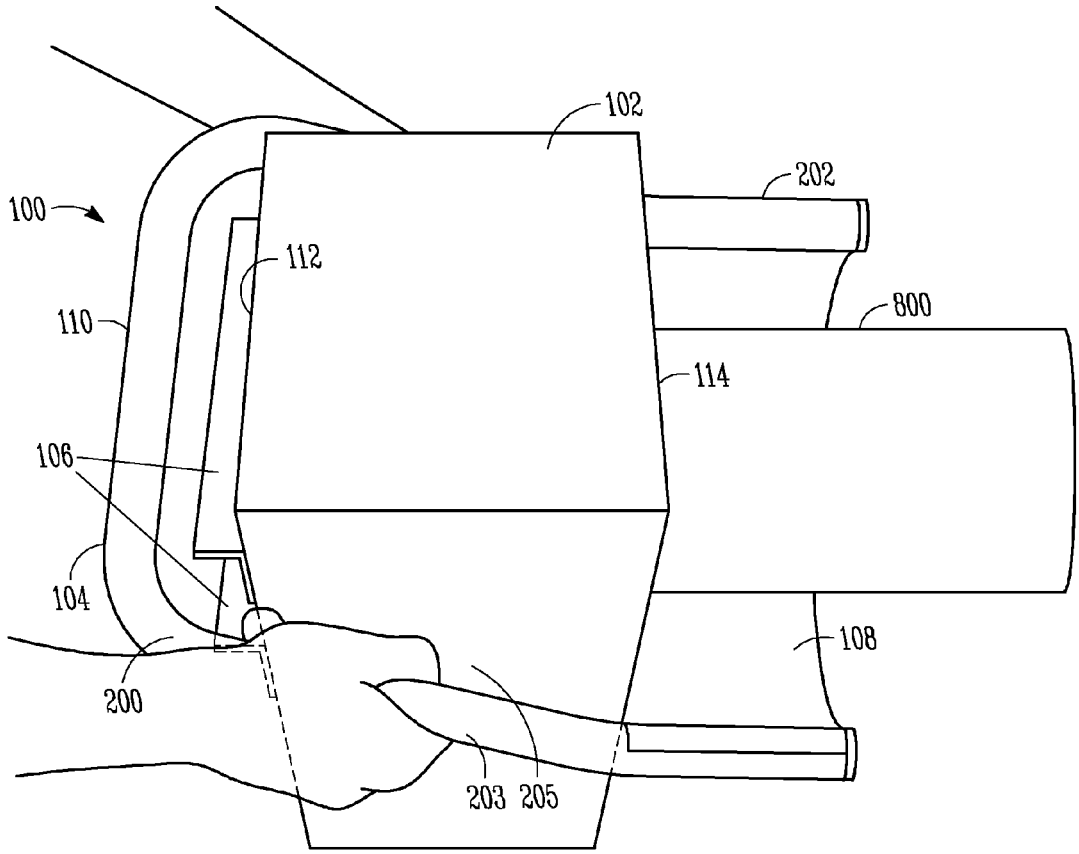
FIG. 9B is a detailed perspective of the hoop support shown in FIG. 7A in a disengaged configuration while the cross piece bar remains secured within the cradle socket in an embodiment of the disclosure.
Figure 9C:
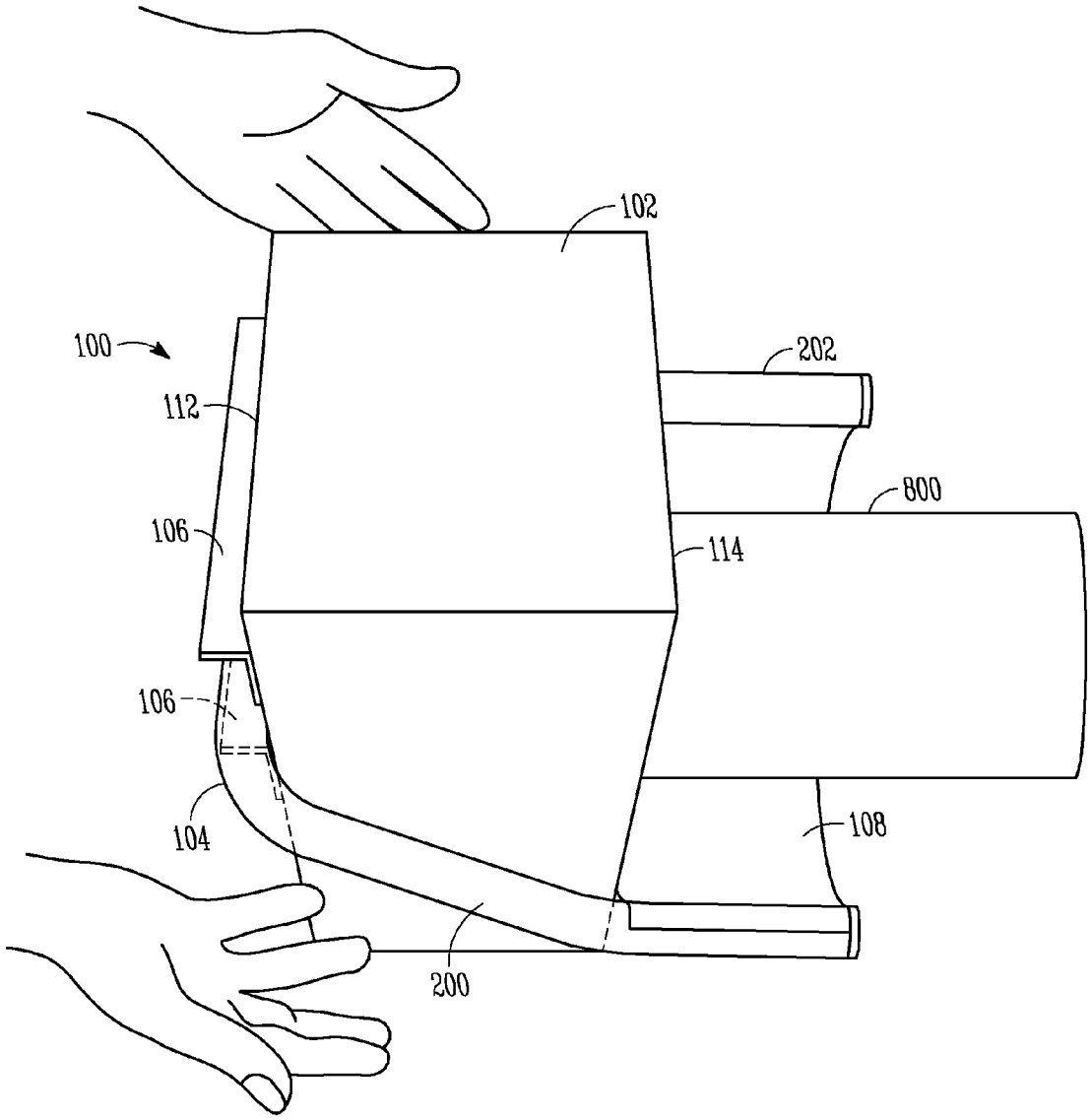
FIG. 9C is a detailed perspective view of the hoop support shown in FIGS. 7A, B coupled along a post at a second engaged position different from the first engaged position while the cross piece bar remains secured within the cradle socket in an embodiment of the disclosure.

FIGS. 9A, 9B and 9C show one example of a method of adjusting the height of the cross piece socket assembly 100. Referring first to FIG. 9A, the cross piece socket assembly 100 is shown with the hoop support 104 in a first engaged position where the hoop anchor portion 110 is engaged with and rests along a first rest bracket 106 (shown in broken lines). The hoop anchor portion 110 is further engaged against a first post surface 112 while the cradle socket 108 including the cradle proximal edge 210 is engaged against the second post surface 114. As previously described, the engagement of the hoop anchor portion 110 against the first post surface 112 and the engagement of the cradle proximal edge 210 to the second post surface 114 provides a ratcheting engagement of the hoop support 104 against the post 102. The ratcheting engagement cooperates with the engagement of the hoop support 104 along the rest brackets 106 to substantially fix the hoop support at the first engaged position.

As shown in FIG. 9A, the hands of the user are positioned within the handhold recesses 205 formed by the handholds 203 on each of the first and second arms 200, 202. The user is thereby able to grasp and manipulate the hoop support 104 while a cross piece bar 800 is positioned within the cradle socket 108. As will be described in further detail and shown in FIGS. 9B, C, the user is able to maintain the grasp on the handholds 203 throughout movement of the hoop support 104 while the cross piece bar 800 is within the cradle socket 108. Removal of the cross piece bar 800 from the cradle socket 108 in order reposition the hoop support 104 from the first to the second engaged positions is thereby avoided.

FIG. 9B shows the hoop support 104 in a disengaged configuration where the hoop anchor portion 110 is disengaged from the rest brackets 106 and the first post surface 112. The cross piece bar 800 is positioned within the cradle socket 108 while the hoop support 104 is in the disengaged configuration. To move the hoop support 104 into the disengaged configuration the user pulls the hoop support 104 away from the cross piece bar 800 thereby disengaging the hoop anchor portion 110 from the first post surface 112 and the first rest bracket 106. The user then moves the hoop support 104 up or down to another rest bracket 106. The cradle proximal edge 210 of the cradle socket 108 is slidably engaged along the second post surface 114 in the disengaged configuration. The cross piece bar 800 is supported by the hoop support 104 and the slidable engagement along the second post surface 114 during movement in the disengaged configuration. The cross piece bar 800 correspondingly moves with the hoop support 104.

The hoop support 104 is reengaged with another rest bracket 106 as shown in FIG. 9C (the second rest bracket is in broken lines). To reengage the hoop support 104 with the rest bracket 106 the user relaxes the pulling forces on the hoop support 104 allowing the moment of the cross piece bar 800 to act on the cradle socket 108 to rotate the hoop support 104 into ratcheting engagement with the post 102 including the first and second post surfaces 112, 114. The ratcheting engagement of the hoop support 104 cooperates with engagement of the hoop anchor portion 110 along the rest bracket 106 to affirmatively position the hoop support 104 at a specified location along the post 102, for instance the second engaged position.

As previously described above, the hoop support 104 is disengaged from a first rest bracket 106, moved into the disengaged configuration and subsequently reengaged with a second rest bracket 106 while continuously carrying the cross piece bar 800 from the first engaged position to the second engaged position. Movement of the hoop support 104 into the second engaged position correspondingly positions the cross piece bar 800 at a second height (See FIG. 9C) relative to a first height corresponding to the location of the first rest bracket 106 (See FIG. 9A). Importantly, the entire operation of disengaging the hoop support 104, moving the hoop support to a second rest bracket 106 and reengaging the hoop support with the post 102 is performed with the cross piece bar 800 continuously received within the cradle socket 108. Added labor and time to remove and reposition the cross piece bar 800, e.g., a heavy log, during adjustment of a bar support to a different height is thereby avoided. Additionally, a single user is able to reposition each of the hoop supports 104 with a cross piece bar 800 mounted in the cradle sockets 108 without requiring assistance from another.

Figure 10:
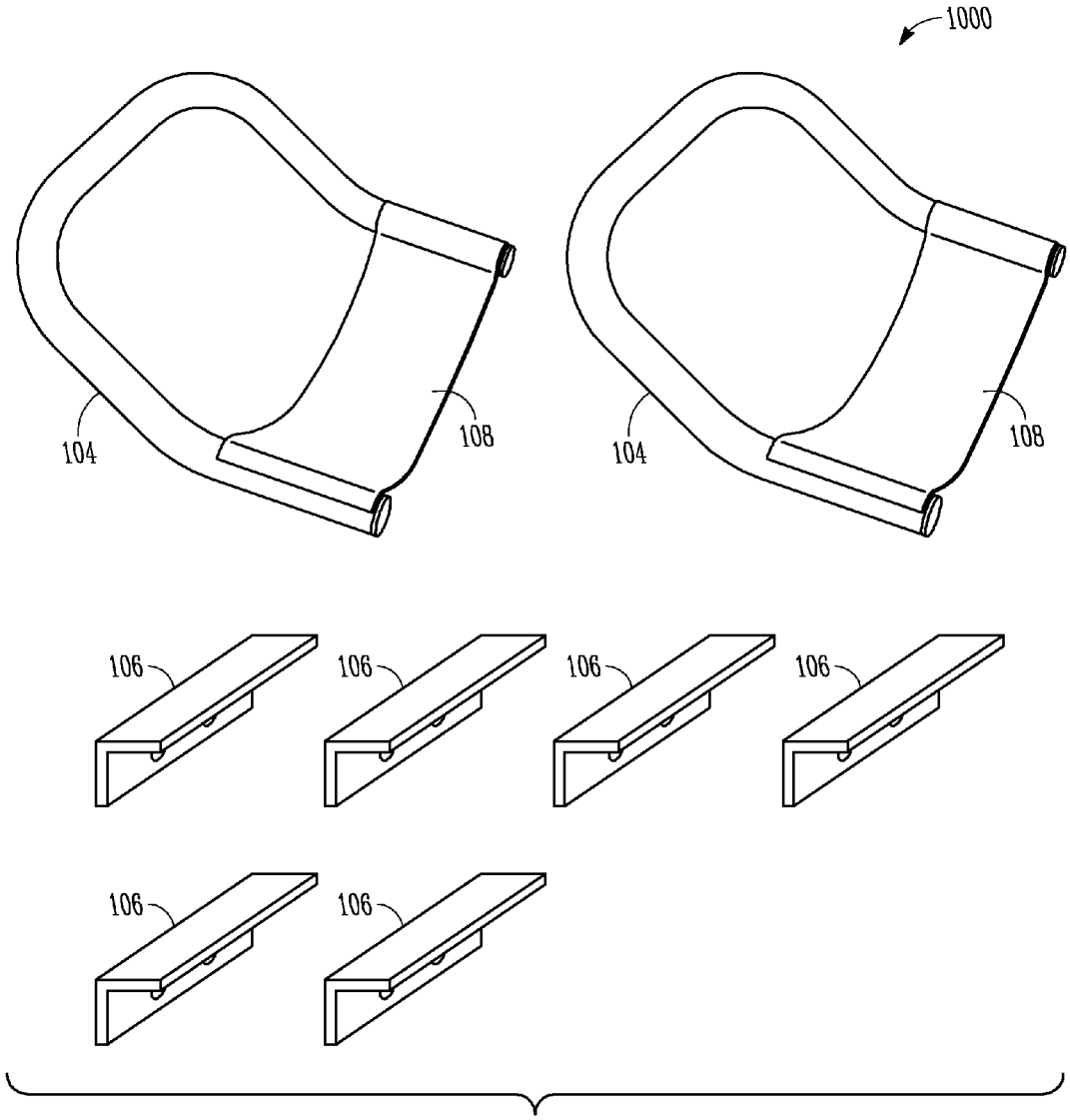
FIG. 10 is a perspective view of one example of a cross piece socket assembly kit including hoop supports and a plurality of rest brackets in an embodiment of the disclosure.

FIG. 10 shows one example of a cross piece socket kit 1000 including hoop supports 104 and rest brackets 106. The hoop supports 104 and the rest brackets 106 are packaged together and include instructions for installation of the rest brackets 106 along posts (e.g., one post 102 is shown in FIGS. 1A, B) and use of the assembly 100. Optionally, the rest brackets 106 include bracket plates 400 as shown in FIG. 4. In still another example, the kit 1000 includes fasteners used to fasten the rest brackets 106 to the posts 102. As previously described, the hoop supports 104, when positioned on the rest brackets 106 coupled along the posts, secure a cross piece bar 800 (See FIG. 8) at a desired height. The cradle sockets 108 of the hoop supports 104 retain the cross piece bar 800 in place when the cross piece bar is impacted with a range of forces less than an impact force that would cause the horse or rider to fall or tumble. The cradle sockets 108 release the cross piece bar when impacted by a horse with sufficient force to cause the animal or the rider to fall or tumble were the cross piece bar fixed along the post.

The present disclosure will be further described by reference to the following example, which is offered to further illustrate various examples of the present disclosure. It should be understood, however, that many variations and modifications may be made while remaining within the scope of the present disclosure.

Example

Prophetic

Impact forces will be measured by load cells attached to a cross piece bar, used with an impact measuring fence made by Competitive Measure, Great Britain. For instance, load cells will be attached along a bottom and a side of the cross piece bar to measure vertical and horizontal impact forces, respectively, as discussed in *Goodyear Safety Research Project* 2008, Hartpury College, Jan. 24, 2009 by Tim Deans and Martin Herbert, incorporated by reference herein in its entirety.

A sufficient sample size of horses (e.g., n>1000) will attempt to jump the cross piece bar. Impacts will be measured for horizontal and vertical force components. Impacts that do not result in a fall or tumble for the horse are considered desirable. The cradle sockets, such as cradle sockets 108, 604 and 704 discussed herein, will then be formed and tested in a similar manner (e.g., with at least one of actual attempted horse jumps or machine driven impacts simulating impacts from a jumping horse).

The hoop supports including the cradle sockets will be constructed with a suitable material not limited to powder coated carbon steel having sufficient structural integrity to reliably bear the weight of the cross piece bar and withstand impact forces at least equal to those measured during testing. The cradle socket shape will be constructed (made deeper, tighter to the bar and the like) to retain the cross piece bar within the sockets over the range of the safe impact forces. The cradle socket shape will be further constructed (made shallow, loose relative to the bar and the like) to permit disengagement of the cross piece bar from the socket for impact forces that exceed the safe forces.

In another example, a falling impact force (i.e., an impact force causing a horse to fall or tumble) greater than the largest measured desired impact force will be chosen. The cradle socket will be formed and tested with repeated impacts to permit disengagement of the cross piece bar for forces greater than or equal to the falling impact force. It is anticipated that the cross piece socket assembly 100 including any of the cradle sockets 108, 604 and 704 will retain the cross piece bar 800 within the sockets when the bar is impacted with desired impact forces, for instance less than about 18 kN of horizontal impact force, less than about 6 kN of vertical impact force and less than about 20 kN of total impact force.

The forces described herein are intended to be exemplary and not absolute values for securing and releasing a cross piece bar. As described in the examples herein and this prophetic example the forces to maintain the cross piece bar in place and release the cross piece bar may vary. For instance, the forces to maintain and release the cross piece bar may vary depending on a number of factors including, but not limited to, the height of the jump, the weight of the horse and rider, the size of the horse, the speed of the horse at impact, the size and weight of the cross piece bar, and the like. Similarly, the shape of the cradle socket 108 (or the other exemplary cradle sockets 604, 704) may be changed to correspond with desired forces to secure and release the cross piece bar.

CONCLUSION

The cross piece socket assembly and methods for using the assembly described above secure a cross piece bar in place at a desired height over a range of impact forces delivered by a jumping horse. The cradle sockets of the hoop supports secure the cross piece bar in place when struck with impact forces that would fail to cause a horse or the rider to tumble or fall. The cradle sockets are configured to release the cross piece bar when struck with impact forces capable of causing a horse or rider to tumble or fall. Stated another way, the shape and size of the cradle sockets permit the cross piece bar to disengage from the cradle sockets when struck with impact forces that could cause a tumble or fall. Because the cradle sockets permit release of the cross piece bar a fall or tumble may be avoided because the obstacle of the bar is removed.

The cross piece socket assembly secures and releases the cross piece bar without using frangible pins, bars or logs, and the like configured to fail when struck with sufficient force. The hoop supports and the cradle sockets are constructed with durable materials capable of withstanding repeated impacts without failure or significant deformation. Further, because the hoop supports secure the cross piece bar in place against forces less than impact forces capable of causing falling or tumbling undesirable delays in competition to reposition or reseat the bar are avoided. Stated another way, unseating of the cross piece bar due to glancing contact and minor impacts is substantially avoided.

Moreover, the rest brackets positioned along the posts provide set locations for engagement with the hoop supports. The hoop supports are positioned along the posts according to the rest bracket locations. The hoop supports interlock with the posts through ratcheting engagement of the hoop anchor portion and another surface of the hoop support (e.g., a proximal edge of the cradle socket). The cross piece bar seated within the cradle sockets is thereby reliably secured at a desired height corresponding to the rest bracket location.

When repositioning of the cross piece bar at a different height is desired the hoop anchor portion is disengaged from a first rest bracket with the cross piece bar still in the cradle socket. For instance, the user applies pulling forces at handholds spaced from the post. The hoop support is slid up or down the post to a desired rest bracket while the cross piece bar remains secured with the cradle socket. The hoop anchor portion is reengaged along the post and rests on the rest bracket. The cross piece bar is immediately ready for jumping at the new height. Time intensive removal and replacement of a cross piece bar to reposition a pin or jump cup is substantially avoided because the cross piece bar remains seated within the cradle socket of the hoop support throughout movement from the first rest bracket to the second rest bracket. Delays in competition are thereby minimized. Additionally, a single user can operate each of the hoop supports that carry the cross piece bar in sequence avoiding the need for additional assistance.

The cross piece socket assembly presented herein has been described in relation to horse jumping. However, the cross piece socket assembly is not so limited. For instance, the hoop supports with the cradle sockets and the rest brackets are used to support wood work pieces for chain saw sculpturing and other wood working activities. The hoop supports position the work pieces at a comfortable height. Additionally, the cross piece socket assembly is used as part of a fence to create a seamless and attractive gate having removable beams without requiring a readily distinguishable and more expensive swinging gate. Further, the cross piece socket assembly is used to erect a balance beam or log at a variety of heights for day care and gymnastics events. The cradle sockets of the hoop support are also configurable for stadium jumping that uses smaller beams and upright posts or standards. For example, the cradle sockets are configured to release the smaller beams when struck with smaller impact forces as required by the event.

The forces described herein are intended to be exemplary and not absolute values for securing and releasing a cross piece bar. As described in the examples herein and the prophetic example above the forces to maintain the cross piece bar in place and release the cross piece bar may vary. For instance, the forces to maintain and release the cross piece bar may vary depending on a number of factors including, but not limited to, the height of the jump, the weight of the horse and rider, the size of the horse, the speed of the horse at impact, the size and weight of the cross piece bar, and the like. Similarly, the shape of the cradle sockets described and their equivalents may be changed to correspond with desired forces to secure and release the cross piece bar.

Although the present disclosure has been described in reference to preferred embodiments, persons skilled in the art will recognize that changes may be made in form and detail without departing from the spirit and scope of the disclosure. It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the disclosure should, therefore, be determined with reference to the appended claims, along with the full scope of equivalents to which such claims are entitled.

What is claimed is:

1. A method for adjusting the height of a cross piece bar comprising:

mounting a hoop support to a substantially vertical post in a first location, the hoop support coupled to a first rest bracket positioned along the substantially vertical post, wherein the hoop support includes a cradle socket configured to receive a cross piece bar;

positioning the cross piece bar within the cradle socket;

disengaging the hoop support from the first rest bracket while the cross piece bar remains present in the cradle socket; and mounting the hoop support to the substantially vertical post at a second location having a second rest bracket while the cross piece bar remains present in the cradle socket, wherein the height of the cross piece bar corresponds to the location of the hoop support.

2. The method of claim 1 further comprising securing the cross piece bar in place against forces less than those generated by impact from a horse chest or horse leg that would cause a horse or rider to tumble or fall.

3. The method of claim 1 further comprising releasing the cross piece bar when the cross piece bar is subject to an impact force capable of causing a horse or rider to fall.

4. The method of claim 3, wherein positioning the cross piece bar within the cradle socket includes releasing the cross piece bar when the cross piece bar is subject to an impact force equal to or less than 20 kN.

5. The method of claim 1, wherein mounting the hoop support includes extending the hoop support around the substantially vertical post.

6. The method of claim 1, wherein disengaging the hoop support includes pulling a hoop anchor portion, and the hoop support includes the hoop anchor portion.

7. The method of claim 1, wherein disengaging the hoop support includes grasping handhold arms extending from the hoop anchor portion to the cradle socket, the handhold arms are spaced from the substantially vertical post and provide finger clearance.

8. The method of claim 1 further comprising:

mounting a second hoop support to a second substantially vertical post with a third rest bracket at a third location corresponding to the first location;

positioning a cross piece bar within a second cradle socket of the second hoop support;

disengaging the second hoop support from the third rest bracket while the cross piece bar remains present in the cradle socket; and mounting the second hoop support to the second substantially vertical post at a fourth location having a fourth rest bracket corresponding to the second location while the cross piece bar remains present in the cradle socket.

9. The method of claim 1, wherein positioning the cross piece bar within the cradle socket includes positioning a cross piece bar end within the cradle socket.

10. The method of claim 1 further comprising engaging a proximal edge of a cradle socket trough with the post while the hoop anchor portion is engaged with one of the first and second rest brackets.

11. The method of claim 1, wherein disengaging the hoop support includes moving the hoop support up or down and slidably engaging a proximal edge of the cradle socket trough with the substantially vertical post during up or down movement.

12. A cross piece socket kit comprising:

a first hoop support and a second hoop support, the first and second hoop supports each include:

a hoop anchor portion, first and second arms extending from the hoop anchor portion, and a cradle socket fixed between the first and second arms, and in an installed configuration the hoop anchor portion, first and second arms and the cradle socket surround a first or second substantially vertical post; and a plurality of rest brackets, and in the installed configuration two or more rest brackets are coupled along each of the first or second post, and the hoop anchor portion selectively engages with each of the plurality of rest brackets.

13. The cross piece socket kit of claim 12, wherein the cradle socket includes a proximal edge, a distal edge and a cradle surface extending between the proximal and distal edges.

14. The cross piece socket kit of claim 13, wherein in the installed configuration the proximal edge of the cradle socket is engaged against a post surface opposed to the two or more rest brackets.

15. The cross piece socket kit of claim 13, wherein in the installed configuration the hoop anchor portion and the proximal edge of the cradle socket are in ratcheting engagement against opposed post surfaces.

16. The cross piece socket kit of claim 12, wherein the cradle socket releases the cross piece bar when the cross piece bar is subject to an impact force capable of causing a horse or rider to fall.

17. The cross piece socket kit of claim 12, wherein the first and second arms include handholds, and the handholds are spaced from a post when the first or second hoop support is in the installed configuration.

18. A cross piece socket assembly used with a substantially vertical post and a cross piece bar, the cross piece socket assembly comprising:

a first resting bracket;

a second resting bracket spaced from the first resting bracket;

a hoop support including:

a hoop anchor portion, the hoop anchor portion is selectively engageable with one of the first and second resting brackets where the first and second resting brackets are positioned along a substantially vertical post, first and second arms extending from the hoop anchor portion, and a cradle socket fixed between the first and second arms wherein the hoop anchor portion is spaced from the cradle socket by the first and second arms; and wherein the cradle socket is configured to secure the cross piece bar within the cradle socket where the cross piece bar is struck with an impact force less than an impact force capable of causing a horse or rider to fall.

19. The cross piece socket assembly of claim 18, wherein the cradle socket is configured to release a cross piece bar secured in the cradle socket where the cross piece bar is struck with an impact force greater than or equal to the impact force capable of causing a horse or rider to fall.

20. The cross piece socket assembly of claim 18, wherein the cradle socket is sized and shaped to secure a cross piece bar in place against horizontal impact forces equal to or less than about 6 kN.

21. The cross piece socket assembly of claim 18, wherein the cradle socket is sized and shaped to secure a cross piece bar in place against vertical impact forces equal to or less than about 18 kN.

22. The cross piece socket assembly of claim 18, wherein a proximal edge of the cradle socket engages against a post surface opposed to the first and second resting brackets when the hoop anchor portion is engaged with one of the first and second resting brackets positioned along the post.

23. The cross piece socket assembly of claim 18, wherein the first and second resting brackets include two or more rest brackets.

24. The cross piece socket assembly of claim 18, wherein the cradle socket is positioned below the hoop anchor portion when engaged with one of the first and second rest brackets.

25. The cross piece socket assembly of claim 18, wherein the first and second arms include angled portions adjacent the hoop anchor portion and level portions adjacent the cradle socket, and the angled portions and level portions position the cradle socket surface perpendicular to a post when the hoop support is engaged with one of the first and second rest brackets positioned along the post.

26. The cross piece socket assembly of claim 18, wherein the first and second arms include handholds, and the handholds are spaced from a post when the hoop support is positioned around the post.

27. The cross piece socket assembly of claim 18, wherein the hoop support is movable between at least a first engaged position, a disengaged configuration and a second engaged position while a cross piece bar is continuously secured within the cradle socket and the first and second rest brackets are positioned along a post, and in the first engaged position the hoop anchor portion is engaged with the first resting bracket, in the disengaged configuration the hoop anchor portion is disengaged from the first resting bracket and movable between the first and second engaged position, and in the second engaged position the hoop anchor portion is engaged with the second resting bracket.

28. The cross piece socket assembly of claim 27, wherein in the first and second engaged positions the hoop anchor portion and a proximal edge of the cradle socket are in ratcheting engagement against opposed post surfaces.

29. The cross piece socket assembly of claim 28, wherein a moment of the ratcheting engagement corresponds to the weight of a cross piece bar.

* * * * *